US008286682B2

(12) United States Patent
Wu

(10) Patent No.: US 8,286,682 B2
(45) Date of Patent: Oct. 16, 2012

(54) PASTER APPLYING APPARATUS

(76) Inventor: Hung-Wen Wu, Taichung (TW)

( * ) Notice: Subject to any disclaimer, the term of this patent is extended or adjusted under 35 U.S.C. 154(b) by 245 days.

(21) Appl. No.: 12/783,285

(22) Filed: May 19, 2010

(65) Prior Publication Data

US 2010/0307691 A1 Dec. 9, 2010

(30) Foreign Application Priority Data

Jun. 3, 2009 (CN) ..... 2009 2 0157800 U

(51) Int. Cl.
*B65D 85/02* (2006.01)
*B65H 35/07* (2006.01)

(52) U.S. Cl. ..... 156/577; 156/574

(58) Field of Classification Search ..... 156/574, 156/577, 579
See application file for complete search history.

(56) References Cited

U.S. PATENT DOCUMENTS

| | | | | |
|---|---|---|---|---|
| 627,052 | A * | 6/1899 | Coe | 156/577 |
| 5,038,492 | A * | 8/1991 | Bryant et al. | 33/758 |
| 2001/0017185 | A1* | 8/2001 | Ronalds | 156/238 |
| 2003/0037886 | A1* | 2/2003 | Kobayashi | 156/577 |
| 2004/0099380 | A1* | 5/2004 | Ho | 156/577 |
| 2005/0145343 | A1* | 7/2005 | Somers et al. | 156/577 |
| 2005/0178507 | A1* | 8/2005 | Hajny et al. | 156/538 |
| 2006/0201632 | A1* | 9/2006 | Pitzen | 156/577 |
| 2006/0213622 | A1* | 9/2006 | Yu Chen | 156/577 |
| 2007/0267455 | A1* | 11/2007 | Huang | 225/20 |
| 2009/0025884 | A1* | 1/2009 | Kinugasa et al. | 156/577 |

* cited by examiner

*Primary Examiner* — Mark A Osele

(57) ABSTRACT

The paster applying apparatus of the present invention includes a main body, a first axle, a cylindrical roller and a shank. The main body includes a working portion and a receiving portion. A joint section is defined between the working portion and the receiving portion, which is adapted to accommodate a paster roll. The first axle is disposed on the working portion, and the roller is disposed about the first axle. The shank is disposed on the joint section. A restraining space is defined between the shank and the roller. Thereby, the paster applying apparatus of the present invention is adapted to apply a paster strip on an object surface.

3 Claims, 4 Drawing Sheets

PASTER APPLYING APPARATUS

BACKGROUND OF THE INVENTION

1. Field of the Invention

The present invention relates to a paster applying apparatus to apply a paster strip on an object surface.

2. Description of the Prior Art

Some wheels are provided with paster strip circles on their side rims. Such paster strip circles are mainly used to reflect lights in order to enhance the night riding safety.

A conventional paster applying apparatus, as disclosed in TW M338838 (hereinafter '838), is provided to apply the paster strip on the object surface, and the apparatus has an abutting plane surface that press the paster against the object surface. As shown in FIG. 4 and FIG. 5 of '838, the paster strip is annularly applied to the side rim of the wheel. However, the abutting plane surface of the apparatus contacts the object surface in a surface contacting manner, as best shown in FIG. 3 of '838. As a result, the paster strip applied thereby might have folds and does not form a real circle on the side rim of the wheel. Thus such (bided paster strip circle would have aesthetic disadvantages.

The present invention is, therefore, arisen to obviate or at least mitigate the above mentioned disadvantages.

SUMMARY OF THE INVENTION

The main object of the present invention is to provide a paster applying apparatus that can smoothly apply a paster on an object surface.

To achieve the above and other objects, the paster applying apparatus of the present invention includes a main body, a first axle, a roller and a shank. The main body includes a working portion and a receiving portion. A joint section is defined between the working portion and the receiving portion, which is adapted to accommodate a paster roll. The first axle is disposed on the working portion, and the roller is disposed about the first axle. The shank is disposed on the joint section. A restraining space is defined between the shank and the roller. Thereby, the paster applying apparatus of the present invention is adapted to apply a paster strip on an object surface.

The present invention will become more obvious from the following description when taken in connection with the accompanying drawings, which show, for purpose of illustrations only, the preferred embodiment(s) in accordance with the present invention.

BRIEF DESCRIPTION OF IF DRAWINGS

DETAILED DESCRIPTION OF THE PREFERRED EMBODIMENTS

Figure 1:
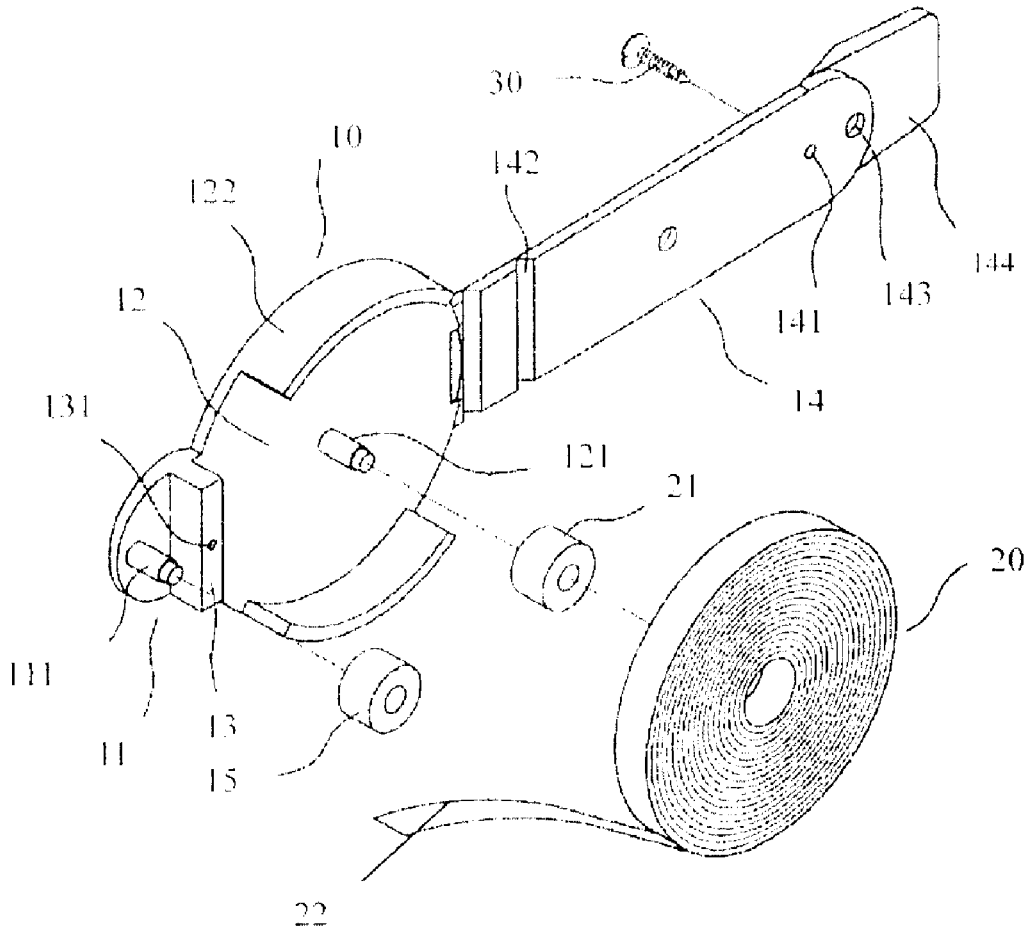
FIG. 1 is a breakdown drawing showing a paster applying apparatus of the present invention.

Please refer to FIG. 1. A paster applying apparatus of the present invention includes a main body 10, a first axle 111, a cylindrical roller 15, a shank 13 and a second axle 121.

The main body 10 includes a working portion 11, a receiving portion 12, a locking portion 14, a second axle 121 and a guider 144. Preferably, the main body 10 is integrally made by plastic. A joint section is defined between the working portion 11 and the receiving portion 12. More specifically, the receiving portion 12 is a circular plate, and the working portion 11 is a semicircular plate laterally extended beside the receiving portion 12 and flushing to the receiving portion 12.

The first axle 111 is disposed on the working portion 11. Specifically, the first axle 111 is perpendicular to the working portion 11. The roller 15 is disposed about the first axle 111. Preferably, the roller 15 is rotatable about the first axle 111. The shank 13 is disposed on the joint section. More specifically, the shank 13 is protrusive from the joint section toward an axial direction of the first axle 111. Thus a restraining space is defined between the shank 13 and the roller 15.

Figure 2:
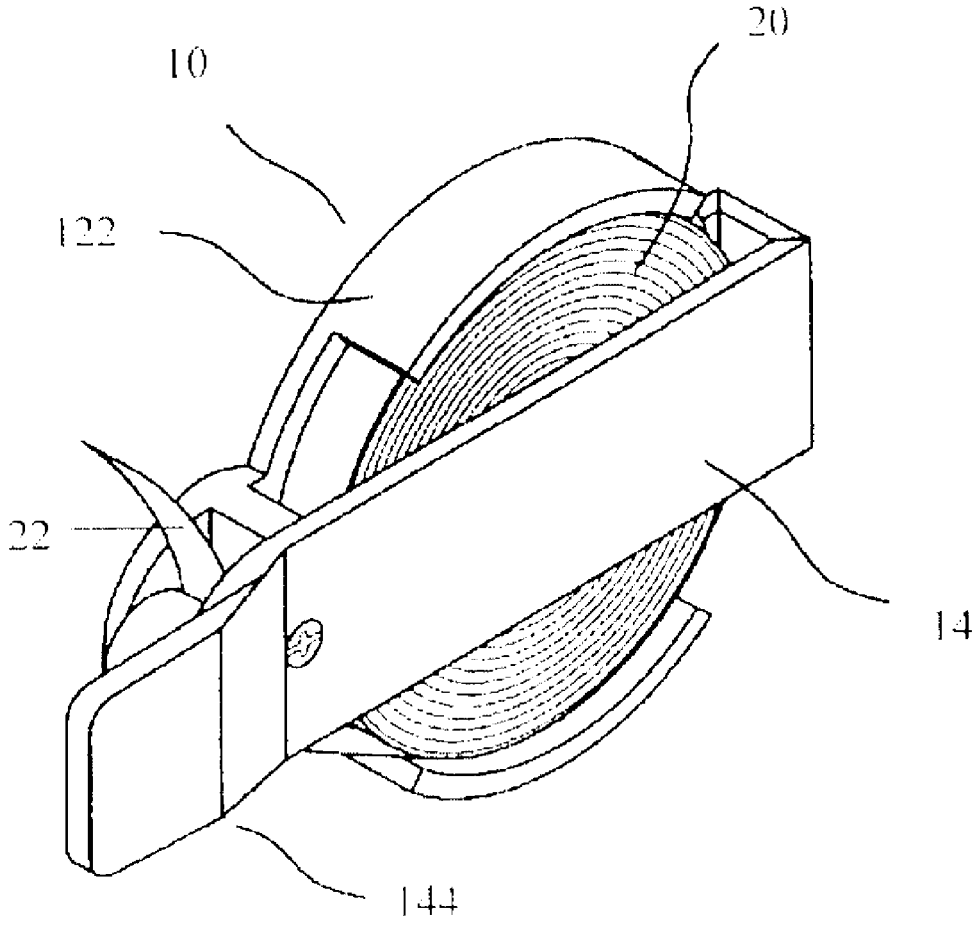
FIG. 2 is a perspective drawing showing a paster applying apparatus of the present invention in which a paster roll is installed thereon.

The receiving portion 12 is adapted to accommodate a paster roll therein. More specifically, the second axle 121 is disposed on the receiving portion for the paster roll 20 to dispose thereabout, while the paster roll may have a core 21 rotatably sleeved about the second axle 121. The paster roll 20 has a strip section 22 extending through the restraining space for later use. To better support the paster roll 20 in the receiving portion 12, two rims 122 are axially formed on a periphery of the receiving portion 12. Further, the locking portion 14 is extended from the receiving portion 12 toward a direction opposite to the working portion 11. A foldable linkage is formed between the receiving portion 12 and the locking portion 14, and two folding notches 142 are formed on the foldable linkage. Thereby, the locking portion 14 overlaps the working portion 11 and the receiving portion 12 as the foldable linkage is folded. Moreover, the shank 13 is formed with a shank positioning hole 131, and the locking portion 14 is formed with an axle engaging bore 143 and a locking positioning hole 141. As such, the axle engaging bore 143 can engage with a distal end of the first axle 111, and a screw 30 or the like can insert through the locking positioning hole 141 and the shank positioning hole 131 to lock the locking portion 14 at the position as shown in FIG. 2. The guider 144 is laterally extended from the locking portion 14. More specifically, the guider 144 is laterally protrusive from the working portion 11 and is perpendicular to the axial direction of the first axle 111. A slanted connecting section connects the guider 144 to the locking portion 14 so that an inner surface of the guider 144 is flush to an outer surface of the locking portion 14 for guiding purposes.

Figure 3:
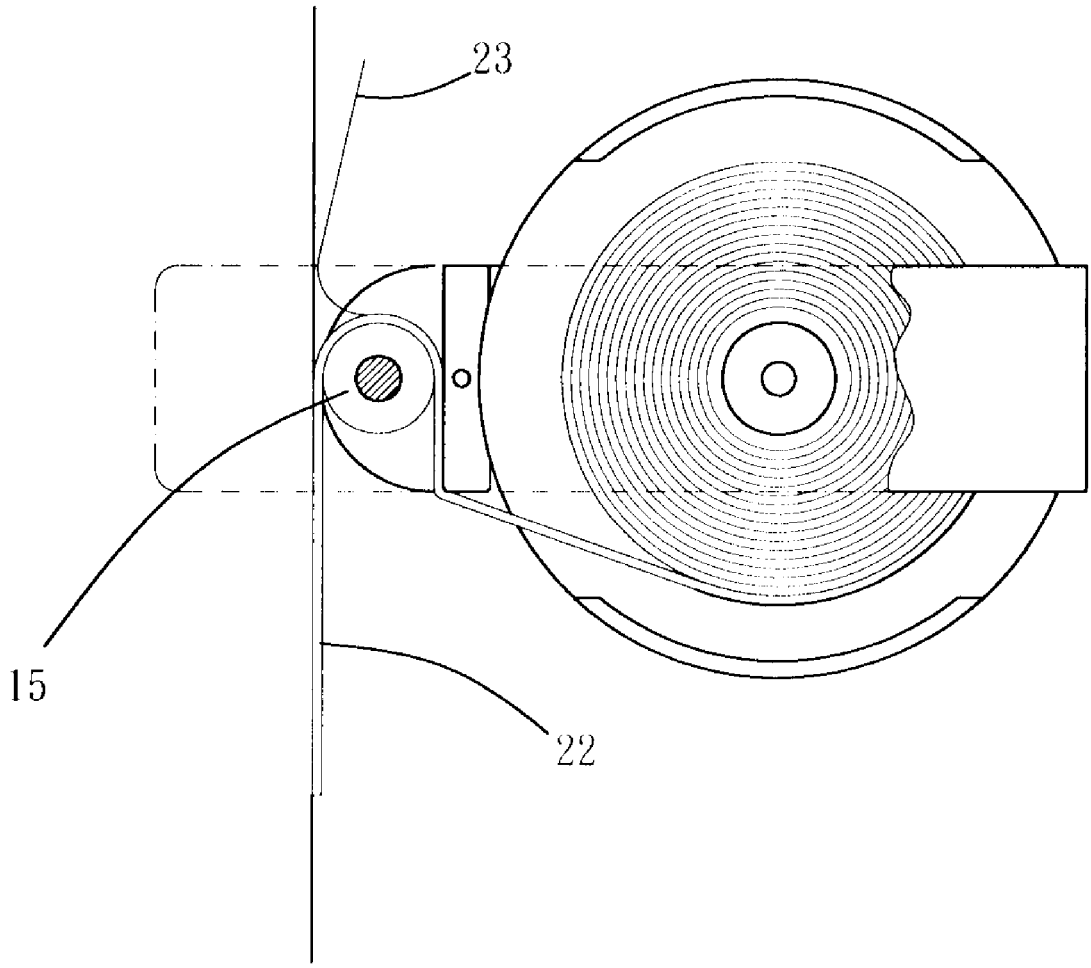
FIG. 3 is a side view showing a paster applying apparatus of the present invention applying the paster strip on an object surface.
Figure 4:
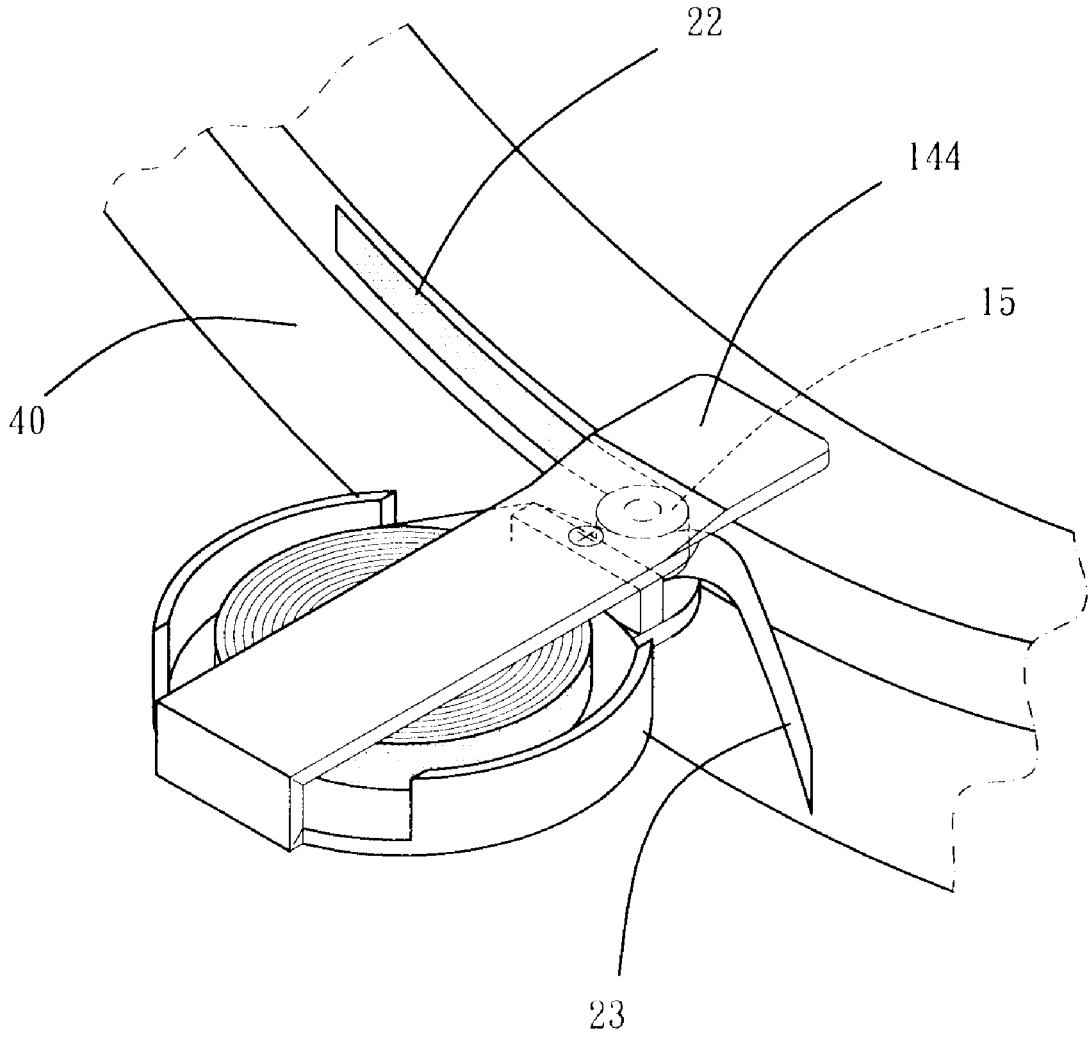
FIG. 4 is a perspective drawing showing a paster applying apparatus of the present invention applying the paster strip on an object surface.

Please refer to FIG. 3 and FIG. 4. To apply the paster strip 22 on the side rim of the wheel 40, the inner surface of the guider 144 can abut against an inner surface of the wheel 40 to annularly guide the paster applying apparatus. The paster strip 22 is, on the other hand, pressed against the side rim surface of the wheel 40 by the roller 15. A release paper 23 is peeled off from the paster strip 22 during the applying process. Due to the line-contacting manner between the roller 15 and the wheel 40, the paster strip 22 can be smoothly applied on the side rim with the least fold and can substantially form a real circle. Besides, the paster applying apparatus of the present invention can also used to apply the paster strip on a non-plane surface, e.g. a protrusive arc surface, because the roller 15 can contact the non-plane surface in the line-contacting manner rather than the surface-contacting manner.

What is claimed is:

1. A paster applying apparatus, comprising:

a main body, comprising a working portion and a receiving portion, a joint section being defined between the working portion and the receiving portion, the receiving portion being adapted to accommodate a paster roll and being circular, at least one rim being axially formed on a periphery of the receiving portion;

a first axle, disposed on the working portion;

a second axle, disposed on the receiving portion, the paster roll being adapted to dispose about the second axle;

a cylindrical roller, disposed about the first axle;

a shank, disposed on the joint section, a restraining space being defined between the shank and the roller;

wherein the main body further comprises a locking portion, the locking portion is extended from the receiving portion toward a direction opposite to the working portion, a foldable linkage is formed between the receiving portion and the locking portion, whereby the locking portion overlaps the working portion and the receiving portion as the foldable linkage is folded.

2. The apparatus of claim 1, wherein the shank is formed with a shank positioning hole, the locking portion is formed with an axle engaging bore and a locking positioning hole, a locking element inserts in the shank positioning hole and the locking positioning hole so as to fasten the locking portion to the shank, the axle engaging bore engages with the second axle.

3. The apparatus of claim 1, wherein the main body further comprises a guider, the guider is perpendicular to the first axle, a slanted connecting section connects the guider to the locking portion.

* * * * *